US005498834A

United States Patent [19]

Inagaki et al.

[11] Patent Number: 5,498,834

[45] Date of Patent: Mar. 12, 1996

[54] ELECTRONIC MUSICAL INSTRUMENT CAPABLE OF GENERATING A RESONANCE TONE TOGETHER WITH A MUSICAL TONE

[75] Inventors: Yoshihiro Inagaki; Kazuo Masaki, both of Hamamatsu, Japan

[73] Assignee: Yamaha Corporation, Japan

[21] Appl. No.: 799,558

[22] Filed: Nov. 27, 1991

[30] Foreign Application Priority Data

Nov. 30, 1990 [JP] Japan ..... 2-330140

[51] Int. Cl.[6] ..... G10H 1/08

[52] U.S. Cl. ..... 84/622; 24/625; 24/723; 24/737

[58] Field of Search ..... 84/601, 602, 604, 84/605, 622, 723, 724, 725, 735, 737, 742, 743, 632, 623, 625

[56] References Cited

U.S. PATENT DOCUMENTS

| | | | |
|---|---|---|---|
| 3,644,656 | 2/1972 | Fender et al. | 84/404 X |
| 4,423,655 | 1/1984 | Turner | 84/620 |
| 4,481,854 | 11/1984 | Dugas | 84/736 |
| 4,483,231 | 11/1984 | Hirano et al. | 84/345 X |
| 4,700,603 | 10/1987 | Takauji et al. | 84/623 X |
| 4,893,538 | 1/1990 | Masaki et al. | 84/605 |
| 4,909,121 | 3/1990 | Usa et al. | 84/606 |
| 4,915,001 | 4/1990 | Dillard | 84/600 |
| 5,029,509 | 7/1991 | Serra et al. | 84/625 |
| 5,123,326 | 6/1992 | Clevinger | 84/743 |
| 5,198,604 | 3/1993 | Higashi et al. | 84/626 |
| 5,252,774 | 10/1993 | Hasebe et al. | 84/618 |
| 5,256,830 | 10/1993 | Takeuchi et al. | 84/625 |

FOREIGN PATENT DOCUMENTS

| | | |
|---|---|---|
| 1145697 | 6/1989 | Japan . |
| 2-110500 | 4/1990 | Japan . |

*Primary Examiner*—Brian Sircus
*Attorney, Agent, or Firm*—Graham & James

[57] ABSTRACT

An electronic musical instrument includes a pitch designation device for designating a pitch of a musical tone, and an operation device for setting an operation state of the electronic musical instrument and outputting operation data according to the operation state. When a pitch of a musical tone to be produced is designated, and operation data is outputted, musical tone parameters are read out from storage in accordance with the designated pitch and the operation data. The musical tone parameters include musical tone parameters directly corresponding to the designated pitch, and musical tone parameters for resonance tones. The musical tones are generated according to these readout musical tone parameters. The electronic musical instrument can obtain a resonance effect, a change in tone color, and the like, which are approximate to those of an acoustic instrument.

15 Claims, 5 Drawing Sheets

ELECTRONIC MUSICAL INSTRUMENT CAPABLE OF GENERATING A RESONANCE TONE TOGETHER WITH A MUSICAL TONE

BACKGROUND OF THE INVENTION

1. Field of the Invention

The present invention relates to an electronic musical instrument and, more particularly, to an electronic musical instrument which can obtain a resonance effect, a change in tone color, and the like, which are approximate to those of an acoustic instrument.

2. Description of the Prior Art

In most acoustic instruments, resonance tones (sounds) are produced in addition to musical tones (musical sounds) produced according to a player's performance, and a deep aftersound unique to an instrument can be obtained. For example, in an acoustic pipe organ, air is supplied to a predetermined stop (a mechanism for supplying a predetermined pipe (or pipes) with air) in accordance with a key ON operation of a player, and the pipe produces a tone. In this case, the acoustic energy of the predetermined pipe causes several non-driven pipes to resonate, thus producing resonance tones. The resonating pipes and the way of resonance of these pipes depend on the pitch of a pipe to which air is supplied, an interval relationship (in the case of a chord performance), a key ON time, a tone volume, the structure and arrangement of the instrument, and the like. When the tone volume of an ON key tone is controlled upon operation of, e.g., a pedal after tone generation is started, resonance tones are changed. In other words, the frequency structures and levels of the resonance tones are changed.

In, e.g., a piano, when the sustain pedal is depressed, strings are released, and resonance tones are produced under the influence of an ON key tone.

As an electronic musical instrument which realizes the same effect as the acoustic instrument, a technique disclosed in Japanese Patent Application Laid-Open No. Sho 60-91393 is known.

Japanese Patent Application Laid-Open No. Sho 60-91393 discloses an electronic musical instrument which produces a plurality of resonance tones having predetermined pitches corresponding to a pitch designated by, e.g., a keyboard. Japanese Patent Application Laid-Open No. Sho 64-91192 discloses a musical tone signal generation apparatus which stores in advance wave data of mixed waves of musical tone and resonance tones (which have to be generated in accordance with the musical tone) in storage, thereby generating deep musical tone including resonance tones, and which appropriately selects resonance tone waveforms in accordance with touch data of a keyboard or operation data of a pedal, and produces mixed tones.

The electronic musical instrument disclosed in Japanese Patent Application Laid-Open No. Sho 60-91393 can only produce resonance tones having pitches corresponding to a designated pitch in addition to a musical tone having the designated pitch. Thus, this instrument cannot delicately change resonance tones according to the touch on the keyboard or the operation amount of the pedal, and a resonance effect or a change in tone color approximate to an acoustic instrument cannot be obtained.

The musical tone signal generation apparatus disclosed in Japanese Patent Application Laid-Open No. Sho 64-91192 appropriately selects wave data of resonance tones in accordance with initial touch data, and performs mixing control according to an original ON key tone waveform and a pedal operation. However, after tone generation is started, the levels of resonance tones can only be controlled a pedal operation. Thus, it is difficult to reproduce a complicated change in resonance tones over some frequencies or levels as in an actual pipe organ.

SUMMARY OF THE INVENTION

It is an object of the present invention to provide an electronic musical instrument which can vary resonance tones and a resonance effect according to a touch on a keyboard, an operation of a pedal, or the like, and can obtain a resonance effect and a change in tone color approximate to those of an acoustic instrument.

In order to achieve the above object, an electronic musical instrument according to the present invention comprises pitch designation means for designating a pitch of a musical tone, operation means for setting an operation state of the electronic musical instrument and for outputting operation data according to the operation state, storage means for storing groups of musical tone parameters of a plurality of musical tones, each group corresponding to combination of a pitch and operation data, musical tone parameter control means for reading out a group of musical tone parameters from said storage means in accordance with the pitch designated by said pitch designation means, and the operation data outputted from said operation means, and musical tone signal generation means for generating a musical tone signal in accordance with the group of musical tone parameters.

The operation means can comprise various operation device (e.g., a pedal, a joystick, a slide volume, or the like) as long as it can output any operation amount (operation data) according to its operation. In this case, a depression amount of a pedal, or a moving amount of a joystick or slide volume is outputted as operation data.

For example, one keyboard may serve as both the pitch designation means and the operation means. In this case, as operation data outputted from the keyboard as the operation means, detection data associated with touches such as initial touch data, after touch data, and the like are outputted.

The storage means stores the plurality of groups of musical tone parameters. The musical tone parameters of the group corresponds to a pitch and operation data. In other words, a group of the musical tone parameters (including parameters of resonance tones) to be read out is determined according to the designated pitch and operation data. The musical tone parameters stored in the storage means are preferably stored in a hierarchical structure (or a tree structure). Musical tone parameters corresponding to a tone color designated in advance may be stored. As the musical tone parameters, those of a musical tone having a designated pitch and those of resonance tones to be produced together with this musical tone are stored. The musical tone parameters include, e.g., pitch data, data for designating a waveform to be generated, a pitch control coefficient according to an after touch strength, a pitch control coefficient according to a pedal operation amount, an amplitude control coefficient according to an after touch strength, an amplitude control coefficient according to a pedal operation amount, tone volume control data, a mixing level setting value, a mixing level control coefficient according to an after touch strength, a mixing level control coefficient according to a pedal operation amount, a bias (offset) amount, parameters of an envelope generator, and the like.

A musical tone signal outputted from the musical tone signal generation means includes a musical tone having a designated pitch, and corresponding resonance tones. In this case, these signals may be mixed, and various acoustic effects such as a reverberation effect may be added to the mixed signal.

The musical tone parameters corresponding to a pitch and operation data need not always be stored in the storage means. For example, musical tones having corresponding pitches (of, e.g., resonance tones) may be directly generated on the basis of a pitch and operation data. In this case, control is made to produce a musical tone having a pitch designated by the pitch designation means, and at least one musical tone having a pitch different from the designated pitch in accordance with the operation data.

When a pitch of a musical tone to be produced is designated by the pitch designation means, and operation data is outputted from the operation means, the musical tone parameter read/output control means reads out a plurality of corresponding musical tone parameters from the storage means in accordance with the designated pitch and the operation data. The musical tone parameters include musical tone parameters directly corresponding to the designated pitch, and musical tone parameters for resonance tones. The readout musical tone parameters are outputted to the musical tone signal generation means. The musical tone signal generation means generates and outputs a musical tone signal in correspondence with the input musical tone parameters.

When musical tones having corresponding pitches (including resonance tones) are directly generated on the basis of the designated pitch and the operation data in place of storing musical tone parameters corresponding to the pitches and operation data in the storage means, control is made to produce a musical tone having a pitch designated by the pitch designation means, and at least one musical tone having a pitch different from the designated pitch in accordance with the operation data.

DETAILED DESCRIPTION OF THE PREFERRED EMBODIMENT

An embodiment of the present invention will be described below with reference to the accompanying drawings.

Figure 1:
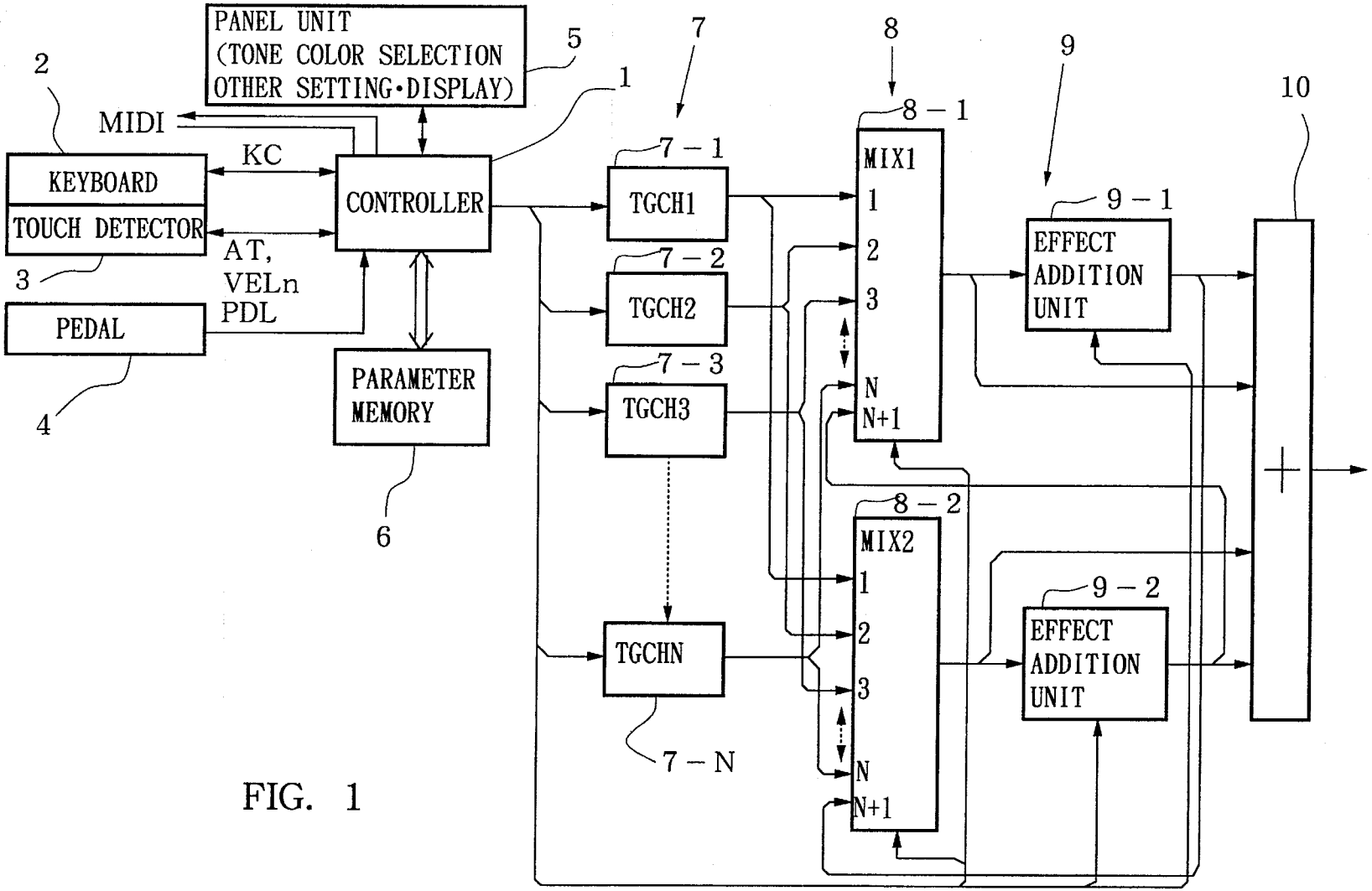
FIG. 1 is a block diagram showing the overall electronic musical instrument according to an embodiment of the present invention.

FIG. 1 shows the overall arrangement of an electronic musical instrument according to an embodiment of the present invention. The electronic musical instrument shown in FIG. 1 comprises a controller 1, a keyboard 2, a pedal 4, a panel unit 5, a parameter memory 6, a sound source unit 7, a mixing processor 8, an effect addition unit 9, and a mixing adder 10.

The keyboard 2 outputs pitch designation data (key code) KC. This electronic musical instrument has 128 keys, and the key code KC has a value ranging between "0" and "127". The keyboard 2 has a touch detector 3. The touch detector 3 outputs a plurality of initial touch data (ON key velocities) VELn (n=0 to 127) in units of keys, and also outputs one after touch data AT for the entire keyboard. The pitch designation data KC from the keyboard 2 is outputted to the controller 1, and the touch data VELn and AT from the touch detector 3 are similarly outputted to the controller 1. A pedal operation amount (depression amount) PDL from the pedal 4 is also outputted to the controller 1.

The controller 1 accesses the parameter memory 6 in accordance with these input data. The parameter memory 6 stores musical tone parameters of a plurality of musical tones (ON key tones and resonance tones) in correspondence with these input data. The memory structure of the parameter memory 6 will be described in detail later with reference to FIG. 4. The controller 1 reads out a plurality of musical tone parameters corresponding to the input data from the parameter memory 6, and outputs them to the sound source unit 7 as a musical tone signal generation means.

The controller 1 has an MIDI input/output function. The panel unit 5 is constituted by various switches and displays, and used for performing setting and display operations such as tone color selection.

The sound source unit 7 comprises N tone generation channels (TGCHs) 7-1 to 7-N. The arrangement of each tone generation channel will be described in detail later with reference to FIG. 2. For the sake of simplicity, the electronic musical instrument of this embodiment assigns eight tone generation channels to one ON key. In this case, one of the eight channels performs tone generation of a musical tone (ON key tone) corresponding to a key ON event, and the remaining seven channels are used for producing resonance tones produced according to the ON key event.

The mixing processor 8 comprises two mixers 8-1 and 8-2. Each mixer properly weights and adds musical tone signal outputs outputted from the tone generation channels 7-n (n=1 to N) to obtain a mixed output. The first mixer 8-1 is used for ON key tones, and the second mixer 8-2 is used for resonance tones. These mixers are controlled to mix output signals from the sound sources.

The effect addition unit 9 comprises first and second effect addition units 9-1 and 9-2. The first effect addition unit 9-1 adds various acoustic effects such as a reverberation effect to an output signal (corresponding to ON key tones) from the first mixer 8-1, and the second effect addition unit 9-2 adds these effects to an output (corresponding to resonance tones) from the second mixer 8-2.

The output from the first effect addition unit 9-1 is fed back as an (N+1)th input of the second mixer 8-2, and the output from the second effect addition unit 9-2 is fed back as an (N+1)th input of the first mixer 8-1. In this manner, when the outputs from the effect addition unit 9 are fed back to the mixing processor 8 in a cross manner, various musical effects can be added.

The output signals from the effect addition units 9-1 and 9-2 are mixed by the mixer (adder) 10, and the mixed signal is output as a final musical tone signal.

Figure 2:
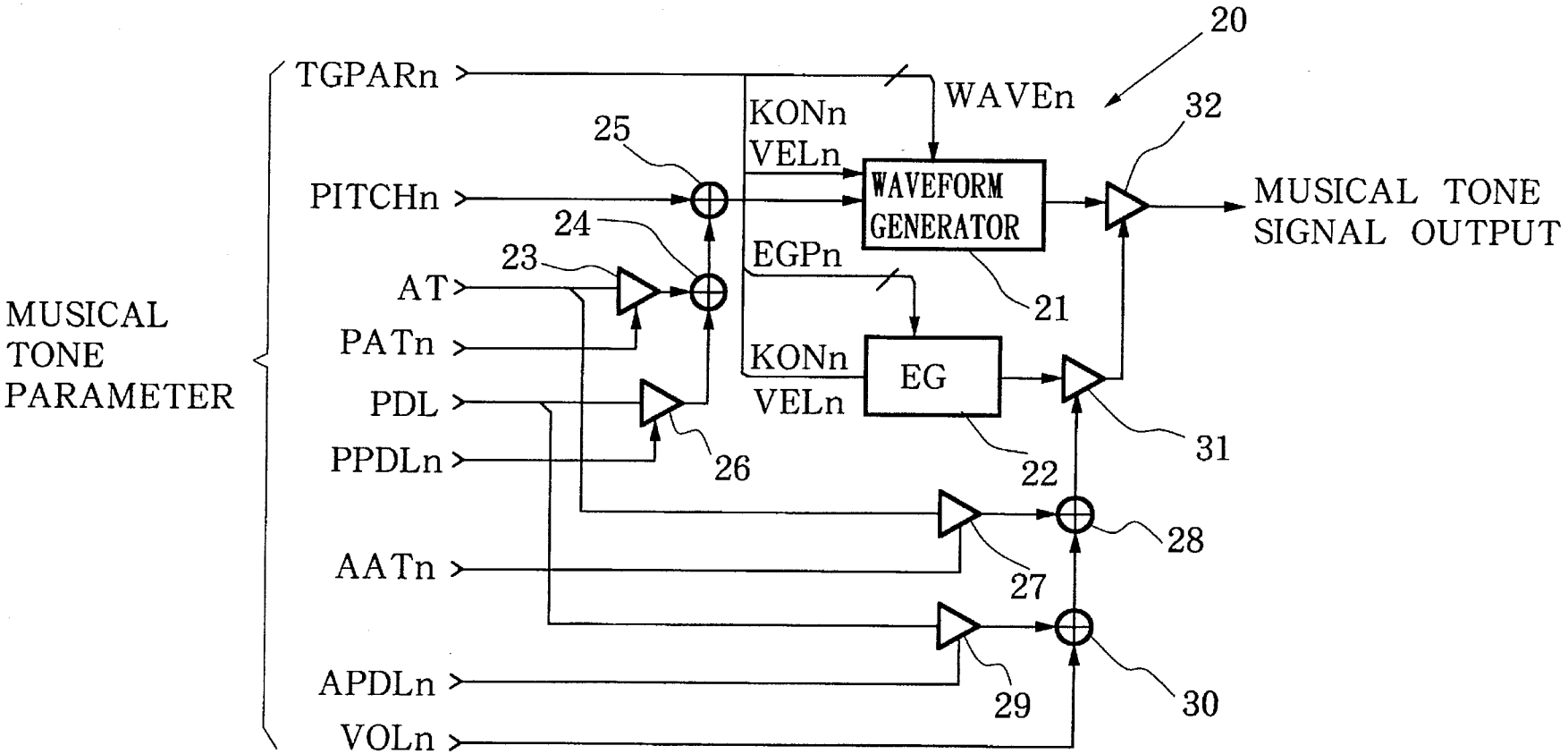
FIG. 2 is a block diagram showing an arrangement of one tone generation channel of a sound source unit of the electronic musical instrument shown in FIG. 1.

FIG. 2 shows an arrangement of one tone generation channel 7-n (n=1 to N) of the sound source unit 7 of the electronic musical instrument of this embodiment. The tone generation channel 7-n receives various musical tone parameters from the controller 1, and outputs a musical tone signal having a waveform and an envelope according to the input musical tone parameters. The following musical tone parameters (input parameters of the tone generation channel 7-n) (1) to (9) are used in the electronic musical instrument of this embodiment.

(1) TGPARn: This parameter indicates various data for designating a musical tone waveform (tone color) to be generated. This parameter includes the following data (a) to (d).
  (a) WAVEn: Generation waveform (group) designation data for designating a waveform (group) to be generated
  (b) EGPn: Envelope generator (EG) parameter for defining an envelope of a musical tone to be generated
  (c) KONn: Key ON signal
  (d) VELn: Initial touch (key ON velocity) signal when each key is depressed (2) PITCHn: This parameter corresponds to pitch designation data of a musical tone to be produced.

(3) AT: This parameter corresponds to an after touch signal indicating an after touch strength of the keyboard.

(4) PATn: This parameter corresponds to a pitch control coefficient according to the after touch strength AT. The pitch of a musical tone (especially, a resonance tone) to be generated changes in accordance with the after touch strength. The pitch control coefficient PATn defines a degree of weighting of after touch data to be reflected in the pitch of the musical tone.

(5) PDL: This parameter corresponds to a pedal operation amount (depression amount) signal. This signal is basically a parameter for adjusting the tone volume of an ON key tone.

(6) PPDLn: This parameter corresponds to a pitch control coefficient according to the pedal operation amount PDL. The pitch of a musical tone (especially, a resonance tone) to be generated changes in accordance with the pedal operation amount (i.e., the tone volume of an ON key tone). The pitch control coefficient PPDLn defines a degree of weighting of the pedal operation amount to be reflected in the pitch of the musical tone.

(7) AATn: This parameter corresponds to an amplitude control coefficient according to the after touch strength AT. The tone volume of a musical tone (especially, a resonance tone) to be generated changes in accordance with the after touch strength. The amplitude control coefficient AATn defines a degree of weighting of after touch data to be reflected in the tone volume of the musical tone.

(8) APDLn: This parameter corresponds to an amplitude control coefficient according to the pedal operation amount PDL. The tone volume of a musical tone (especially, a resonance tone) to be generated changes in accordance with the pedal operation amount (i.e., the tone volume of an ON key tone). The amplitude control coefficient APDLn defines a degree of weighting of the pedal operation amount to be reflected in the tone volume of the musical tone.

(9) VOLn: This parameter corresponds to tone volume control data for defining a basic tone volume level of a musical tone to be generated.

The tone generation channel 7-n shown in FIG. 2 comprises a waveform generator 21 and an envelope generator 22. An after touch signal AT and a pitch control coefficient (according to the after touch strength AT) PATn are multiplied with each other by a multiplier 23, and the output from the multiplier 23 is inputted to an adder 24. A pedal operation amount signal PDL and a pitch control coefficient (according to the pedal operation amount PDL) PPDLn are multiplied with each other by a multiplier 26, and the output signal from the multiplier 26 is inputted to the adder 24. The adder 24 adds the output signals from the multipliers 23 and 26, and outputs the sum to an adder 25. The adder 25 adds musical tone pitch designation data PITCHn to the output from the adder 24, and inputs the sum to the waveform generator 21.

The waveform generator 21 receives the output from the adder 25, and some of various data TGPARn for designating a musical tone waveform (tone color) to be generated in this tone generation channel, i.e., generation waveform designation data WAVEn, a key ON signal KONn, and an initial touch (key ON velocity) signal VELn, and generates a predetermined waveform according to these parameters.

The envelope generator 22 receives some of the various data TGPARn for designating a musical tone waveform, i.e., an EG parameter EGPn, a key ON signal KONn, and an initial touch signal VELn, and outputs envelope waveform data according to these parameters.

The after touch signal AT is multiplied with an amplitude control coefficient (according to the after touch strength AT) AATn by a multiplier 27, and the output from the multiplier 27 is inputted to an adder 28. The pedal operation amount signal PDL is multiplied with an amplitude control coefficient (according to the pedal operation amount PDL) APDLn by a multiplier 29, and the output from the multiplier 29 is inputted to an adder 30. The adder 30 adds the output from the multiplier 29 to the tone volume control data VOLn, and outputs the sum to the adder 28. The adder 28 adds the output from the multiplier 27 to the output from the adder 30. The output from the adder 28 is multiplied with the output from the envelope generator 22 by a multiplier 31, and final envelope waveform data is outputted to a multiplier 32.

The multiplier 32 multiplies the envelope waveform outputted from the multiplier 31 to the waveform data outputted from the waveform generator 21, thus obtaining a final musical tone signal output.

Figure 3:
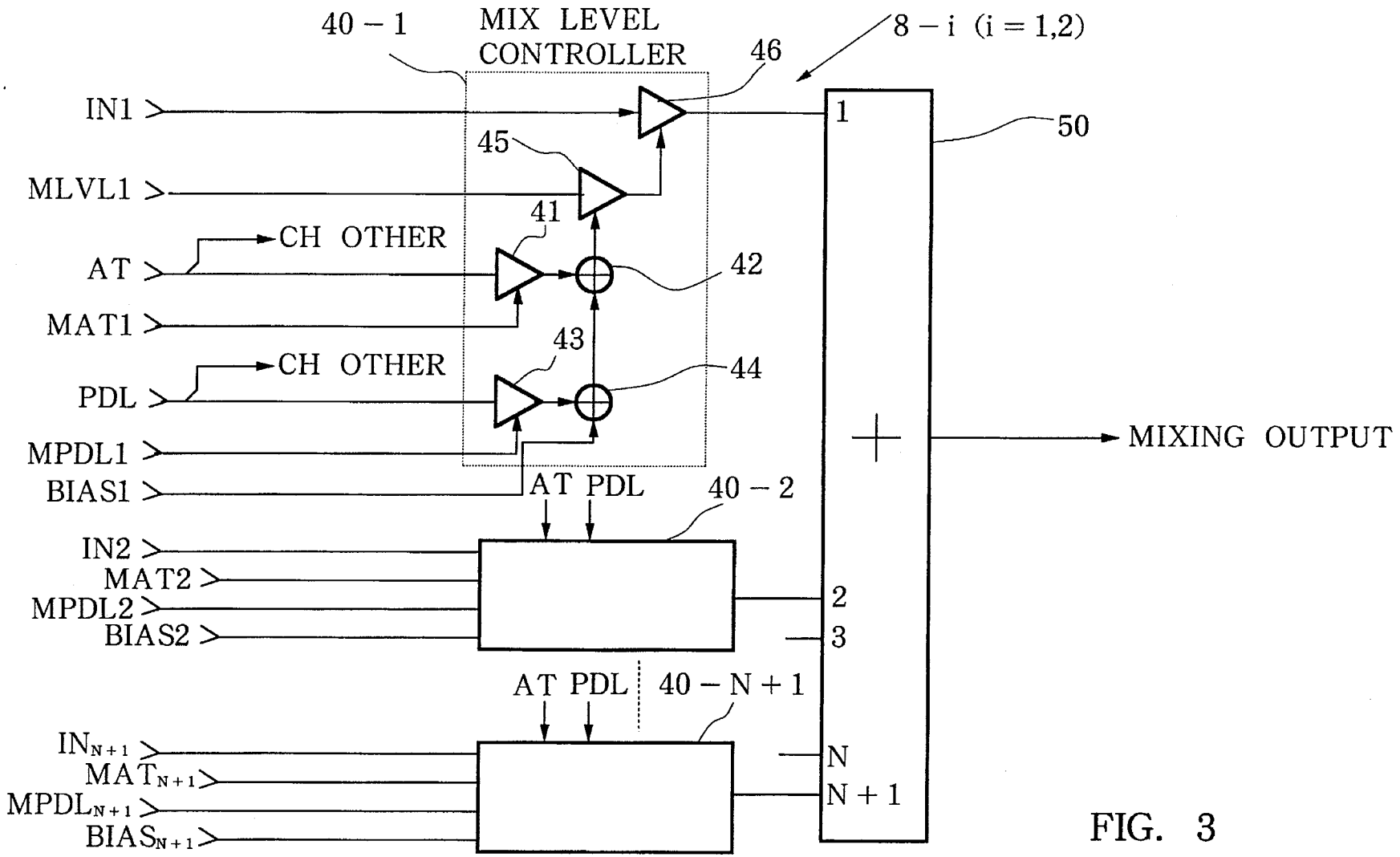
FIG. 3 is a block diagram showing an arrangement of a mixing processor of the electronic musical instrument shown in FIG. 1.

FIG. 3 shows the mixer 8-i (i=1 and 2) of the electronic musical instrument of this embodiment. The mixer 8-i receives the output signals from the tone generation channels 7-1 to 7-N (FIGS. 1 and 2), and also receives an output signal fed back from the effect addition unit 9 as an (N+1)th input. The mixer 8-i also receives various parameter data. Parameters (1) to (5) inputted to the mixer 8-i will be described below.

(1) INn: This parameter corresponds to a musical tone signal input. Musical tone signal outputs from the tone generation channels 7-1 to 7-N serve as musical tone signal inputs INn (n=1 to N). A musical tone signal input $IN_{N+1}$ is a feedback input from the effect addition unit 9 described above.

(2) MLVLn: This parameter corresponds to a mixing level setting value. This value defines a basic mixing level of the corresponding input signal.

(3) MATn: This parameter corresponds to a mixing level control coefficient according to the after touch strength AT. The mixing level of a musical tone (especially, a resonance tone) to be produced changes in accordance with the after touch strength. The mixing level control coefficient MATn defines a degree of weighting of after touch data to be reflected in the mixing level of the musical tone.

(4) MPDLn: This parameter corresponds to a mixing level control coefficient according to the pedal operation amount PDL. The mixing level of a musical tone (especially, a resonance tone) to be produced changes in accordance with the pedal operation amount (i.e., the tone volume of an ON key tone). The mixing level control coefficient MPDLn defines a degree of weighting of the pedal operation amount to be reflected in the mixing level of the musical tone.

(5) BIASn: This parameter corresponds to a bias (offset) amount. This parameter defines a minimum mixing level when both the after touch signal AT and the pedal operation amount signal PDL are "0".

The mixer 8-i comprises N+1mixing level controllers 40-n (n=1 to N+1) in correspondence with the number of input signals.

The mixing level controller 40-1 comprises multipliers 41, 43, 45, and 46, and adders 42 and 44. The multiplier 41 multiplies the after touch signal AT with a mixing level control coefficient MAT1, and outputs the product to the adder 42. The multiplier 43 multiplies the pedal operation amount signal PDL with a mixing level control coefficient MPDL1, and outputs the product to the adder 44. The adder 44 adds the output from the multiplier 43 to a bias amount BIAS1, and outputs the sum to the adder 42. The adder 42 adds the output from the multiplier 41 to the output from the adder 44, and outputs the sum to the multiplier 45. The multiplier 45 multiplies the output value from the adder 42 with a mixing level setting value MLVL1, and outputs the product to the multiplier 46. The multiplier 46 multiplies a musical tone input signal IN1 with a level control coefficient outputted from the multiplier 45, and outputs the product to an adder 50. In this manner, the level of the musical tone input signal IN1 is controlled.

The mixing level controllers 40-n (n=2 to N+1) have the same arrangement as that of the mixing level controller 40-1, and respectively control the levels of input signals IN2 to $IN_{N+1}$.

The adder 50 adds the output signals from these mixing level controllers 40-n (n =1 to N+1), and outputs a final mixing signal.

Figure 4:
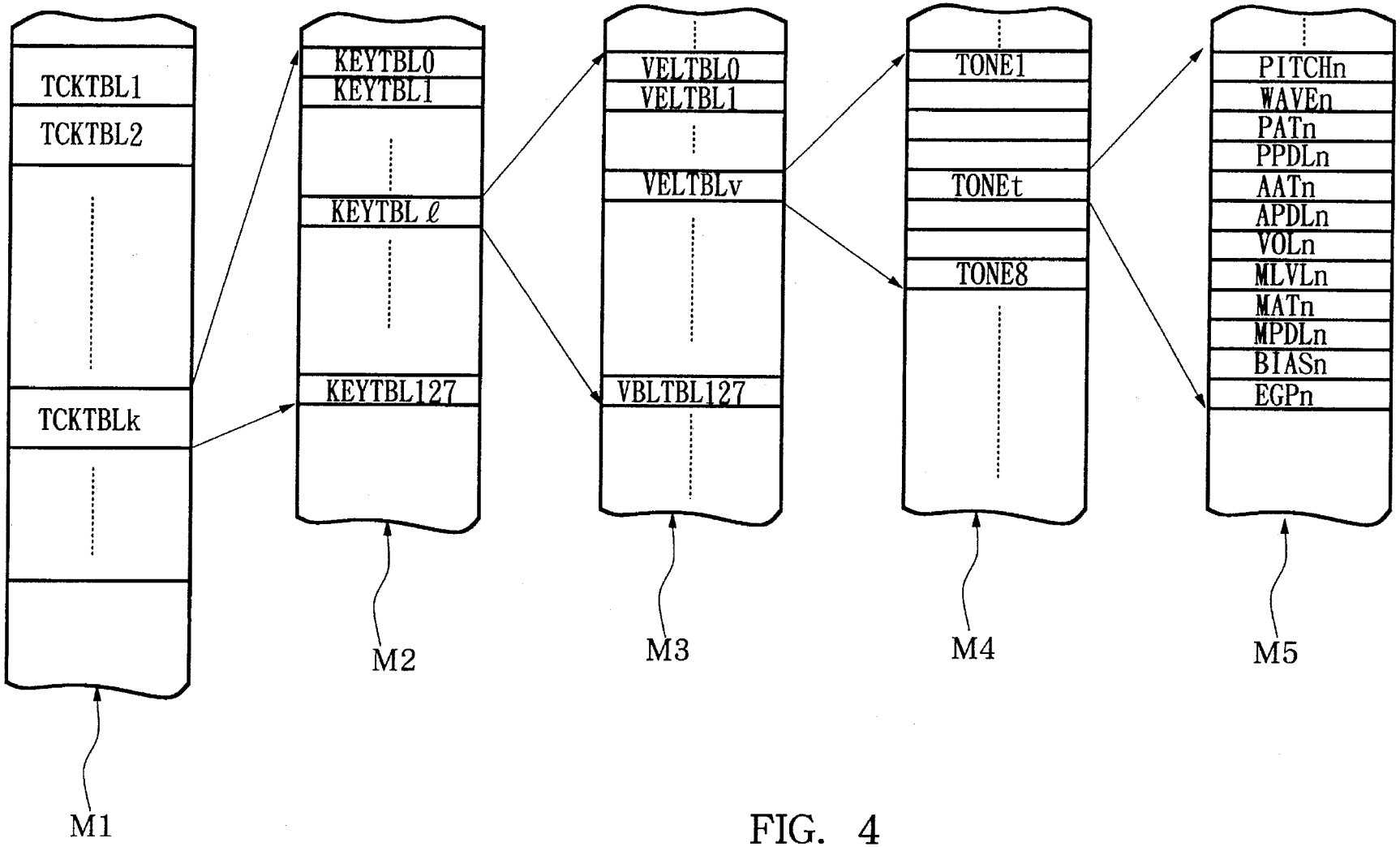
FIG. 4 is a schematic view showing a parameter memory structure used in the electronic musical instrument shown in FIG. 1.

Parameters and the parameter memory structure used in the electronic musical instrument of this embodiment will be described below with reference to FIG. 4. In the electronic musical instrument of this embodiment, the parameter memory 6 (FIG. 1) is hierarchically used. In FIG. 4, reference numerals M1 to M5 respectively designate layers. Parameters stored in the respective layers will be described below in the following paragraphs (1) to (5).

(1) First Layer M1

The first layer M1 stores touch/key tables TCKTBLk corresponding in number to selectable tone colors. Each table stores a tone generation instruction data group in units of tone colors to be selected in a table format. One of the tables TCKTBLk is addressed in correspondence with a tone color (tone color number =k) selected by a user on the panel unit 5 (FIG. 1). (2) Second Layer M2

Each of the touch/key tables TCKTBLk has data of the following contents in the second layer M2. More specifically, each table has tone generation instruction data tables KEYTBLl (l=0 to 127) in units of key codes. When a key having a key code =l is depressed, the corresponding table KEYTBLl is addressed to produce a musical tone corresponding to this ON key. (3) Third Layer M3

Each of the tone generation instruction data tables KEYTBLl in units of key codes has data of the following contents in the third layer M3. More specifically, one table KEYTBLl consists of a group of 128 tone generation instruction data tables VELTBLv corresponding to an initial touch (velocity) value VELn (having a value ranging between "0" and "127"). When the initial touch value VELn=v upon a key ON event, the corresponding table VELTBLv is addressed to produce a musical tone corresponding to this ON key.

(4) Fourth Layer M4

Each of the tone generation instruction data tables VELTBLv in units of initial touch values has data of the following contents in the fourth layer M4. More specifically, one table VELTBLv consists of tone color designation/tone generation mode designation data tables TONEt in units of eight channels to be subjected to tone generation. Data in these eight tables TONEt (t=1 to 8) are outputted toward eight tone generation channels assigned for tone generation.

(5) Fifth Layer

Each of the tables TONEt in the fourth layer stores various parameter data for a corresponding channel to be subjected to tone generation. These parameters will be presented below. Note that these parameter data are read out from the parameter memory 6 by the controller 1, and are outputted to the assigned tone generation channels of the sound source unit 7. Therefore, for the sake of simplicity, the parameter data are represented by the same symbols as those of signal names (or data names) used in FIGS. 1 to 3.

(a) PITCHn: Pitch designation data (tone generation pitch frequency data) of a musical tone to be generated
(b) WAVEn: Generation waveform (group) designation data for designating a waveform of a musical tone having a tone color to be generated
(c) PATn: Pitch control coefficient according to the after touch strength
(d) PPDLn: Pitch control coefficient according to the pedal operation amount
(e) AATn: Amplitude control coefficient according to the after touch strength
(f) APDLn: Amplitude control coefficient according to the pedal operation amount
(g) VOLn: Tone volume control data
(h) MLVLn: Mixing level setting value
(i) MATn: Mixing level control coefficient according to the after touch strength
(j) MPDLn: Mixing level control coefficient according to the pedal operation amount
(k) BIASn: Bias data (offset amount)
(l) EGPn: Envelope generator (EG) parameter The operations of the electronic musical instrument of this embodiment will be described below with reference to the flow charts shown in FIGS. 5 and 6.

Figure 5:
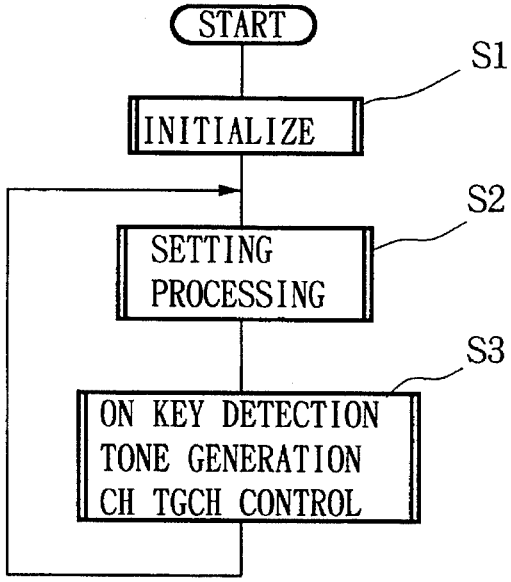
FIG. 5 is a flow chart showing a main routine of the electronic musical instrument shown in FIG. 1.

FIG. 5 is a flow chart showing the main .routine of the electronic musical instrument of this embodiment. When processing is started in this electronic musical instrument, the units of the system are initialized in step S1. In step S2, setting processing, e.g., tone color designation, an effect parameter setting operation, or the like, is performed by the panel unit 5. In this processing, the corresponding touch/key table TCKTBLk in the parameter memory 6 is addressed in accordance with a designated tone color (tone color number k), thus preparing for a performance. In step S3, ON key detection and tone generation channel control of the sound source unit are executed, and the flow then returns to step S2.

Figure 6:
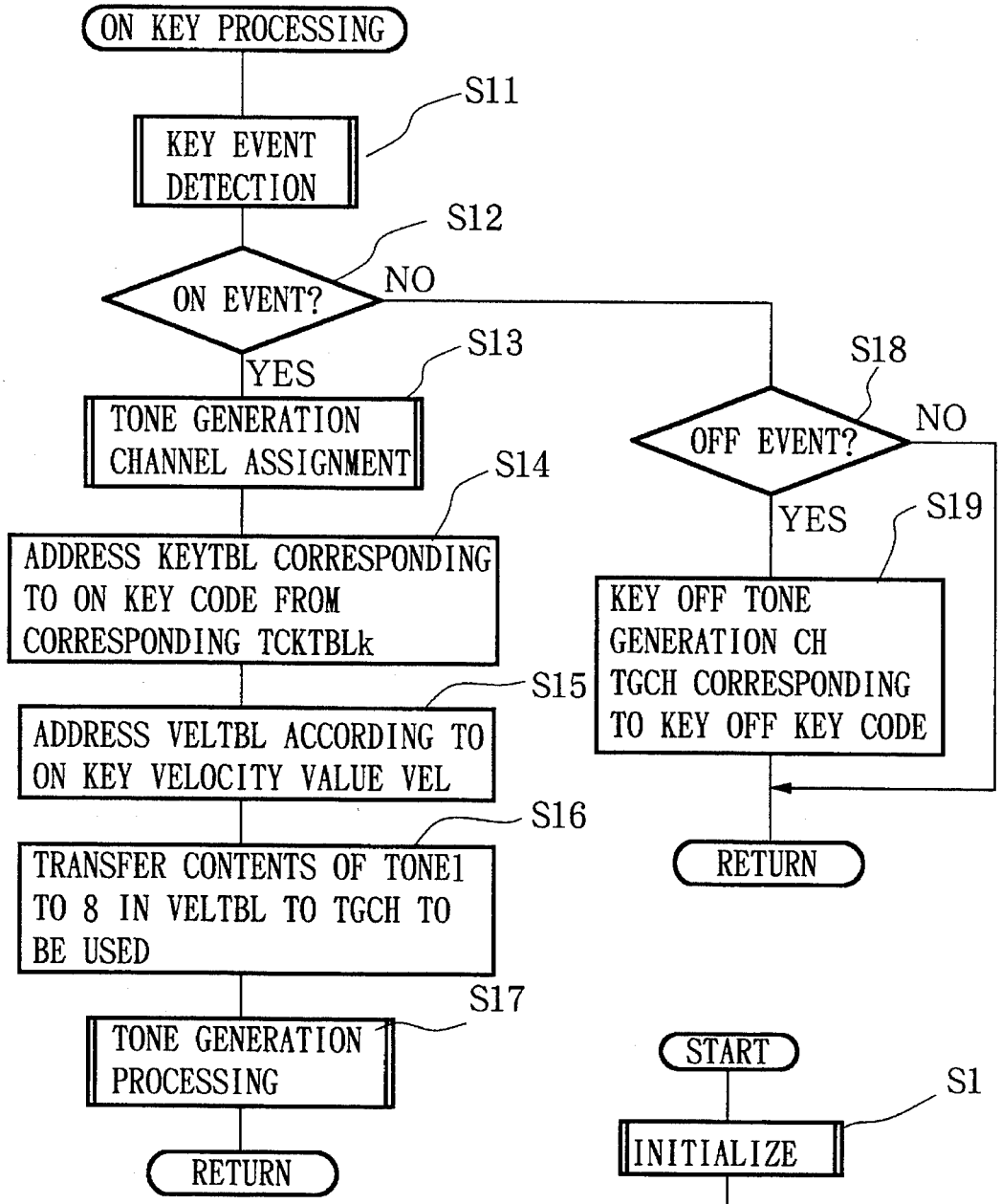
FIG. 6 is a flow chart showing a key ON processing routine of the electronic musical instrument of this embodiment.

The ON key detection and tone generation channel control processing in step S3 in FIG. 5 will be described below with reference to FIG. 6.

In step S11, a key event is detected. It is checked in step S12 if the detected key event corresponds to an ON event of any key. If Y (YES) in step S12, tone generation channels are assigned to the ON key in step S13. In this electronic musical instrument, as described above, since a designated ON key tone and seven resonance tones are produced in response to one key ON event, eight channels are assigned in step S13.

In step S14, the tone generation instruction data table KEYTBLl corresponding to a key code KC=l of the ON key is addressed from the already designated touch/key table TCKTBLk. In step S15, the tone generation instruction data table VELTBLv in the third layer M3 (FIG. 4) corresponding to a velocity (initial touch) value VELn=v of the ON key is addressed. In step S16, the contents of eight tone color designation/tone generation mode designation data to be produced as an ON key tone and resonance tones are read out from the designated data table TONEt (t=1 to 8) in the parameter memory 6, and the readout data are transferred to the assigned channels of the sound source unit. The tone color designation/tone generation mode designation data to be transferred to the respective channels correspond to those stored in the fifth layer M5 (FIG. 4) in the parameter memory 6.

In step S17, a key ON signal KON is supplied to the eight channels to produce tones, and the flow returns to the main routine.

If it is determined in step S12 that the detected key event is not an ON event, it is checked in step S18 if the detected key event is an OFF event. If YES in step S18, key OFF processing of the tone generation channels of the sound source unit corresponding to a key code of the OFF key is executed in step S19, and the flow returns to the main routine. If it is determined in step S18 that the detected key event is not an OFF event, the flow directly returns to the main routine.

In this embodiment, after touch data may be independently detected in units of keys, and after touch signals ATn may be obtained in units of keys. In mixing processing, various mixing coefficients may be controlled to change over time. For example, the amplitude and mixing level of each channel may be changed over time using the envelope generator EG.

In the above embodiment, eight channels are assigned to one key ON event to produce one ON key tone and resonance tones. However, the present invention is not limited to this. For example, a musical tone may be produced using an arbitrary number of channels in accordance with setting of tone generation tables. The number of channels to be assigned to each key ON event may be changed.

Furthermore, the parameter memory 6 may have layers according to an after touch value (an after touch value by another key) or a pedal operation amount upon a key ON event. Thus, new layers classified based on these data may be added to prepare for new tone generation tables, and control may be made based on these tables.

Musical tone parameters to be supplied to the sound source unit, and musical tone parameters to be supplied to the effect addition unit may be classified. For example, the musical tone parameters to be supplied to the effect addition unit may be transferred to the corresponding effect addition units to have contents selected by a player prior to a performance.

As described above, according to the present invention, musical tone parameters of a plurality of musical tones corresponding to pitches and operation data are stored in advance. Corresponding parameters are read out from the storage means in accordance with the designated pitch and operation data, and are outputted as a musical tone signal. For example, a frequency component structure or combination of resonance tones, or level control in units of components can be finely designated, and a resonance tone effect and a change in tone color approximate to those of an acoustic instrument can be obtained.

Furthermore, musical tones having corresponding pitches (of, e.g., resonance tones) may be directly produced based on a pitch and operation data of ON key without using the above-mentioned tables.

What is claimed is:

1. An electronic musical instrument for generating a plurality of resonance tones along with a designated musical tone in order to simulate resonance effects of an acoustic musical instrument, comprising:

pitch designation means for designating a pitch of a musical tone to be generated;

operation means for detecting an operation state of the electronic musical instrument in addition to pitch designation and for outputting operation data according to the operation state;

storage means for storing a plurality of groups of musical tone parameters of a plurality of musical tones, each group corresponding to a combination of pitch and operation data;

musical tone parameter control means for reading out a first group of musical tone parameters for said designated musical tone from said storage means in accordance with the pitch designated by said pitch designation means and the operation data output from said operation means and for reading out a second group of musical tone parameters for said plurality of resonance tones from said storage means in accordance with the pitch designated by said pitch designation means and the operation data output from said operation means;

musical tone signal generation means for generating a first musical tone signal having said designated pitch in accordance with the first group of musical tone parameters and for generating a plurality of second musical tone signals corresponding to said plurality of resonance tones in accordance with the second group of musical tone parameters; and mixing means for mixing said first and second musical tone signals, thereby enabling generation of said resonance tones and said musical tone, wherein each of said plurality of resonance tones is controlled independently in accordance with said operation data output from said operation means.

2. An electronic musical instrument according to claim 1, wherein said operation means includes a pedal.

3. An electronic musical instrument according to claim 1, wherein one keyboard serves as both said pitch designation means and said operation means.

4. An electronic musical instrument according to claim 3, wherein said keyboard outputs the touch data as the operation data.

5. An electronic musical instrument according to claim 1, wherein said operation means includes means for detecting operation states varying in time lapse during operation of said electronic musical instrument whereby a resonance tone component of said musical tone signals to be generated is varied in accordance with variation of said detected operation states.

6. An electronic musical instrument according to claim 5, wherein said operation means includes means for sequentially outputting operation data varying in time lapse in accordance with said operation states, and said musical tone parameter control means sequentially reads out said second group of musical tone parameters for the resonance tone in accordance with the designated pitch and said sequentially output operation data.

7. An electronic musical instrument according to claim 1, further comprising effect addition means for adding various acoustic effects to a mixed output from said mixing means.

8. An electronic musical instrument according to claim 7, wherein said effect addition means adds a reverberation effect to the mixed output.

9. An electronic musical instrument for generating a plurality of resonance tones along with a musical tone in order to simulate resonance effects of an acoustic musical instrument, comprising:

pitch designation means for designating a pitch of the musical tone to be generated;

operation means for detecting an operating state of the electronic musical instrument and for outputting operation data according to the operation state;

control means for producing musical tone control data in accordance with the pitch designated by said pitch designation means and the operation data output from said operation means, the musical tone control data, including first musical tone control data for a musical tone having the designated pitch, and second musical tone control data for a plurality of resonance tones having pitches different from the designated pitch respectively, the pitches of the resonance tones being determined in accordance with the designated pitch and the operation data;

musical tone signal generation means for generating a first musical tone signal having said designated pitch in accordance with the first musical tone control data from said control means and for generating a plurality of second musical tone signals of said plurality of resonance tones in accordance with the second musical tone control data from said control means; and mixing means for mixing said first and second musical tone signals, thereby enabling generation of said resonance tones and said musical tone, wherein each of resonance tones is controlled independently in accordance with said operation data output from said operation means.

10. An electronic musical instrument according to claim 9, wherein one keyboard serves as both said pitch designation means and said operation means.

11. An electronic musical instrument according to claim 10, wherein said keyboard outputs the touch data as the operation data.

12. An electronic musical instrument according to claim 9, wherein said second musical tone is varied and controlled in accordance with said operation data output from said operation means.

13. An electronic musical instrument according to claim 9, further comprising effect addition means for adding various acoustic effects to a mixed output from said mixing means.

14. An electronic musical instrument according to claim 13, wherein said effect addition means adds a reverberation effect to the mixed output.

15. A resonance tone generating device for use with an electronic musical instrument, comprising:

a plurality of operation devices for designating operation states of said electronic musical instrument, said plurality of operation devices including at least a pitch designation device;

a parameter memory for storing a plurality of groups of musical tone parameters to generate plural musical tone signals, said groups of musical tone parameters corresponding to plural combinations of said operation states of said plurality of operation devices and including at least a group of resonance tone parameters to generate a plurality of resonance tone signals in conjunction with a musical tone signal, said musical tone signal having a pitch designated by said pitch designation device, and said plurality of resonance tone signals having a pitch different from said designated pitch of said musical tone signal and independently controlled in accordance with said designated pitch and an output from at least one of said plurality of operation devices;

a controller for reading out said groups of musical tone parameters from said parameter memory according to said plural combinations of said operation states; and a signal generator for generating said plurality of resonance tone signals in accordance with said group of parameters read from said parameter memory, whereby said signal generator generates said plurality of resonance tone signals in accordance with said operation states of said plurality of operation devices.

* * * * *